US005329743A

United States Patent [19]

Legnante

[11] Patent Number: 5,329,743

[45] Date of Patent: Jul. 19, 1994

[54] VARIABLE SET-UP REUSABLE CENTERING FRAME

[76] Inventor: Vincenzo A. Legnante, No. 57, Via Volterrana, Tavernuzza Di Impruneta, 50029 Firenze, Italy

[21] Appl. No.: 474,856

[22] PCT Filed: Mar. 14, 1989

[86] PCT No.: PCT/IT89/00017

§ 371 Date: Sep. 13, 1990

§ 102(e) Date: Sep. 13, 1990

[87] PCT Pub. No.: WO89/08758

PCT Pub. Date: Sep. 21, 1989

[30] Foreign Application Priority Data

Mar. 15, 1988 [IT] Italy ..... 47733 A/88

[51] Int. Cl.[5] ..... E04F 21/00

[52] U.S. Cl. ..... 52/749; 52/127.1; 52/127.2; 269/904

[58] Field of Search ..... 52/749, 127.1, 127.2, 52/122.1, 128, 86; 269/904

[56] References Cited

FOREIGN PATENT DOCUMENTS 58516 12/1890 Fed. Rep. of Germany .
857440 10/1952 Fed. Rep. of Germany .
445720 11/1912 France .
1001768 8/1965 United Kingdom .

*Primary Examiner*—Carl D. Friedman
*Assistant Examiner*—Christopher T. Kent
*Attorney, Agent, or Firm*—Beveridge, DeGrandi, Weilacher & Young

[57] ABSTRACT

A variable set-up, reusable center frame for the realization of concrete and masonry arches and for restoration applications. The center frame includes a succession of Y-shaped modular rod members. Each branch is provided at its end with a first and second upper hinge joint and a lower hinge joint. The lower hinge joint is provided with a slide rod, and a plate-shaped connection locks the slide rod in place. The upper hinge joints are hingedly connected to supporting saddles extending out of a lower surface of a flexible forming member which is placed in contact with the member being supported. The slide rods are adjustable in position with respect to the lower branch such that the space between the lower branches can be adjusted to achieve different formations in the forming member.

23 Claims, 13 Drawing Sheets

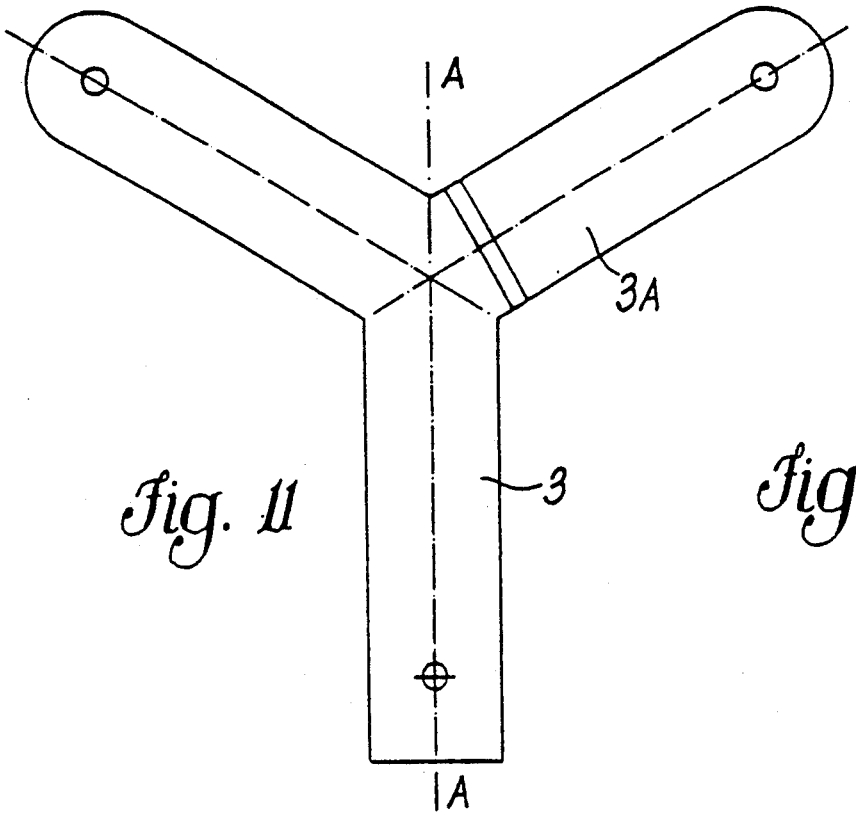
Fig. 11
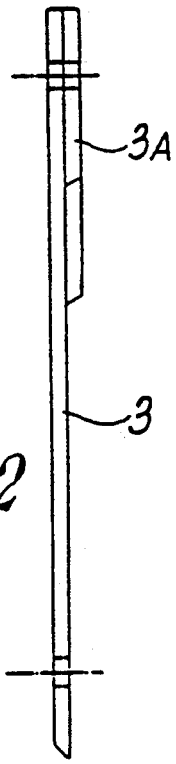
Fig. 12
Fig. 13
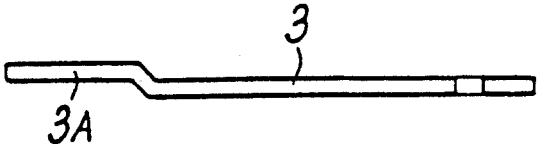

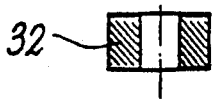
Fig. 20A
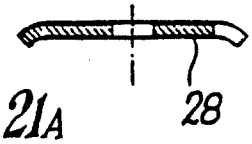
Fig. 21A
Fig. 20B
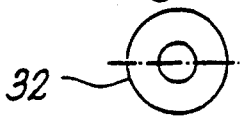
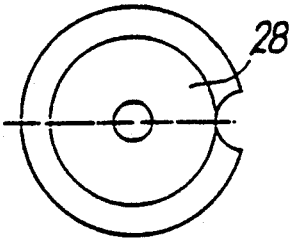
Fig. 21B
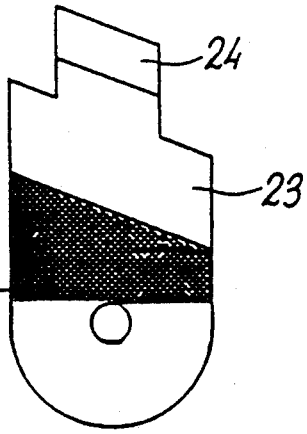
Fig. 22A
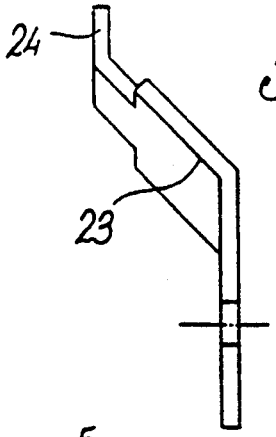
Fig. 22B
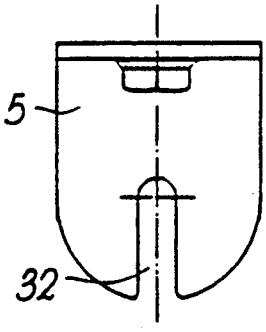
Fig. 23
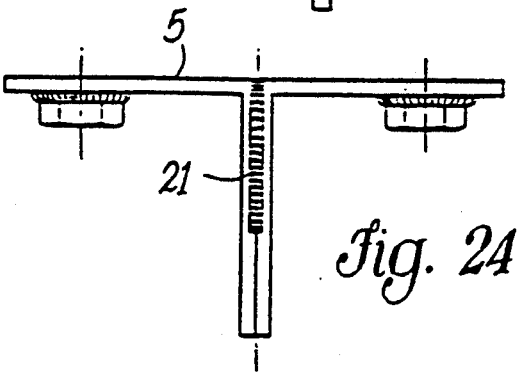
Fig. 24
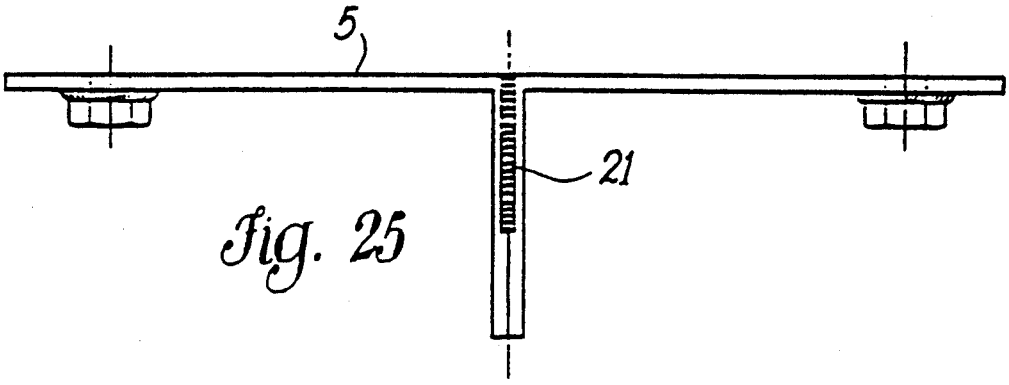
Fig. 25

Fig. 26
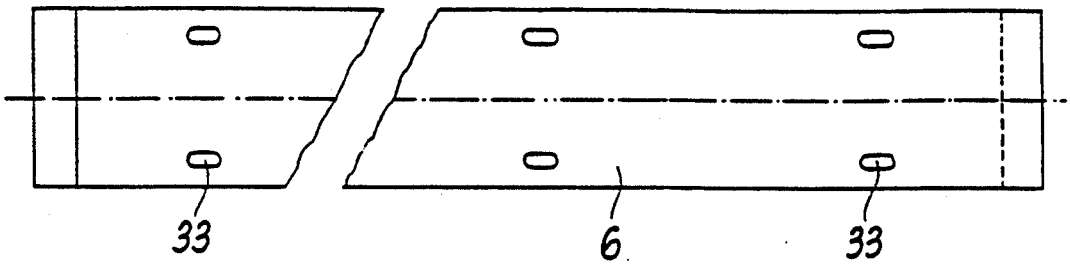
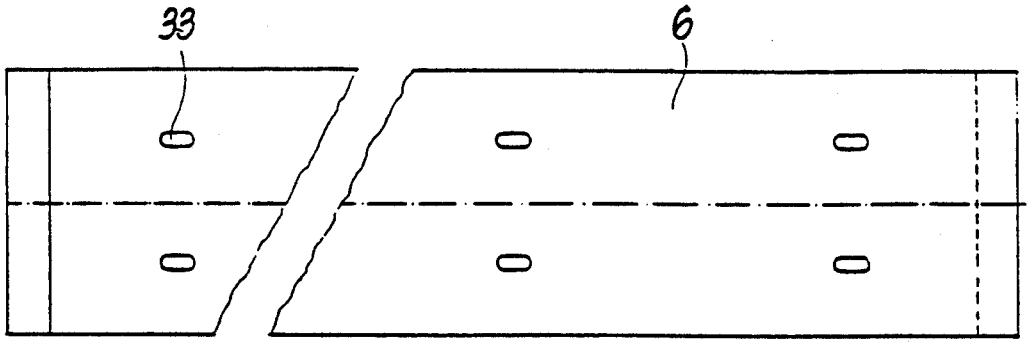
Fig. 27
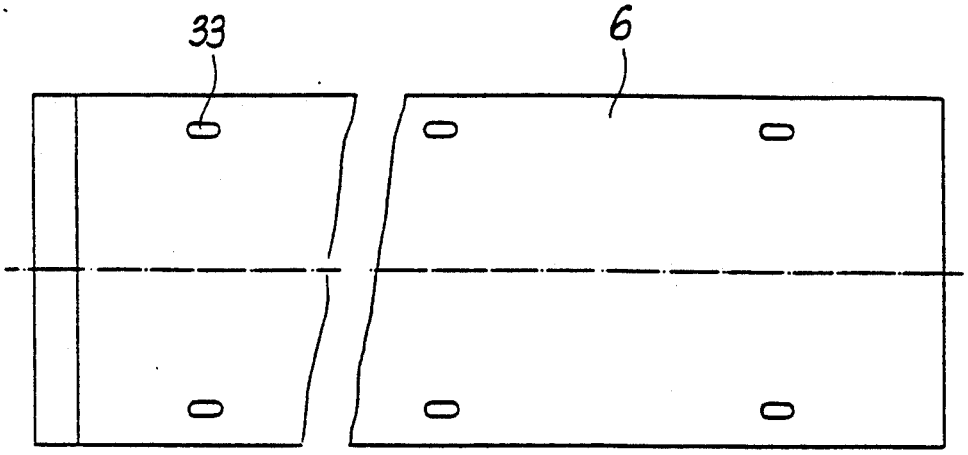
Fig. 28

VARIABLE SET-UP REUSABLE CENTERING FRAME

FIELD OF THE INVENTION

The present invention relates to a variable set-up, reusable centering frame for use as a movable and stationary structure.

More particularly, this invention relates to a variable set-up, reusable centering frame for the realization of masonry and concrete arches, for restoration applications in which arches or vaults are present, said centering frame being also usable as an open formwork, for propping purposes, as a truss for furnishing solutions in apartments, as a forming member for dies, as far as its employment as a movable structure is concerned, but it is also usable as a supporting structure for false ceilings or for solutions to furnishing problems in apartments in which curved surfaces are present as far as its employment as a stationary structure is concerned.

BACKGROUND DISCUSSION

As is well known, centering frames already known essentially consist of provisional structures made up of steel rods or of timber members with said structures being intendend for supporting arches and vaults during construction, and having extrados dummy boards on which the intrados of the arch structure to be built or restored is supported.

Among the centering frames already known, and more particularly among those which are not designed for large buildings, the movable and the stationary centering frames are to be distinguished. The first ones, as is well known, are employed when a set of identical structures are to be realized, or when a single structure can be made up by putting together the parts one after another, whereas the latter are to be partially or totally disassembled for being employed again.

Anyway, both the movable and the stationary centering frames already known are characterized in that they are to be completely or partially disassembled to adapt the same to different bending radii, as well as to the different load values and distributions.

Accordingly, one of the main drawbacks of the structures employed at the present time consists in the need for adapting and designing on each occasion the structure of the centering frame according to the kind of the desired bending.

Moreover, especially in the case of timber structures, the structures already designed and built according to some specified parameters can be hardly employed again for different solutions.

Stated in a schematic way, the structure of the centering frames adopted up to the present time in building technology is made up of a curved profile lattice set, and it is supported just at its sides, or it is possibly endowed also with intermediate supports, the whole structure resting directly on the ground or on the vertical bearing structures.

The assembling of such type of structure is generally difficult and requires the presence of skilled labor; in addition, such step must be necessarily carried out during installation.

A further drawback consists in the fact that, once the structure has been assembled, it is extremely difficult to substitute any possible defective parts.

Such drawbacks, especially if concerned with centering frame structures intended for restoration purposes in urban areas, affect at a remarkable extent both the progress of works and the cost of the restoration intervention.

SUMMARY OF THE INVENTION

In order to overcome such drawbacks, this invention suggests the realization of a variable set-up centering frame, which is easily adaptable to different bending radii as well as to any possible kind of vaults and to different loads, said centering frame having the structure of an isostatic truss and comprising a series of rod modular members which are connected by hinge joint systems at the knots and by two fastening and forming plate systems.

Accordingly, the specific object of the present invention consists in a variable set up, reusable centering frame for use as a movable and as a stationary structure. The centering frame comprises a succession of rod planar Y-shaped modular members, a first and a second upper hinge joint, a lower hinge joint which is provided with a slide rod member, and continuous longitudinal upper connection means. The connection means preferably include some square joint connection means that are provided between said rod planar Y-shaped modular members and said longitudinal upper connection member. The first and the second upper hinge joints are made up of rotary and fastening means for employment with said square joint connection means. The lower hinge joint consists, at the point corresponding to the front portion of each one of said rod planar Y-shaped modular members, of sleeve means, slide rod means which can rotate with respect to said sleeve, bolt fastening means (at the point corresponding to the rear portion). Friction fastening means are provided and have a rough inner surface. The slide rod members also have rough surfaces in the longitudinal portion for friction engagement with said fastening means.

Advantageously, said rod planar modular members, according to a preferred kind of embodiment, are in the shape of a triangle.

According to a preferred embodiment of the present invention, said fastening means are made up of bent plate movable means which are provided with tooth means for engagement and fastening of said Y-shaped planar rod modular member, and they are also made up of square-shaped members having an inner rough groove.

Advantageously, the variable set-up reusable centering frame according to the present invention is characterized in that hole means are provided on each one of the two Y-shaped planar modular rod members at the ends of each truss, said hole means being provided for realizing the engagement with saddle means for connection with prop supporting means.

Moreover, again according to the present invention, eyelet holes are provided on said longitudinal connection members for fastening the square-shaped members so as to absorb any possible clearances and tolerances.

According to an alternative kind of embodiment of the present invention, said centering frame is employed as a truss or a bearing lattice structure for curved profile false ceilings.

In said arrangement, said Y-shaped planar modular rod members are employed in the overturned position and they have, in their upper part, a double hinge joint into which the bent ends of two slide rod members converge, said members being connected to an adjustment sleeve and having means for connection to the false ceiling structure, said connection means being arranged at the ends of each one of the two bent members.

Advantageously, said connection means are made up of square-shaped means which are connected to small block means intended for supporting the structure of the false ceiling directly or through intermediate profiles.

The present invention will be disclosed in the following just for illustrative and not for limitative purposes with reference to the enclosed drawings wherein:

BRIEF DESCRIPTION OF THE PREFERRED EMBODIMENT

FIG. 11 shows a front view of a Y-shaped modular member of said truss;

FIG. 12 shows a side view of the Y-shaped modular member illustrated in FIG. 11;

FIG. 13 shows a vertical cross-sectional view along the line A—A of FIG. 11 of the Y-shaped modular member;

FIGS. 20A and 20B represent respectively a vertical cross-sectional view and a front cross sectional view of the sleeve member arranged within the inner cavity of the end of the slide rod;

FIGS. 21A and 21B represent respectively a vertical cross-sectional view and a front view of the covering and fastening member of the end of said slide rod;

FIGS. 22A and 22B represent respectively a front and a side view of the square-shaped member arranged between the Y-shaped modular member and the other component parts of the lower joint;

FIG. 23 represents a front view of a square-shaped member for connecting the reverse form plate to the upper ends of the Y-shaped modular member;

FIGS. 24 and 25 represent a side view of two square-shaped members as illustrated in FIG. 23, which are welded at the points corresponding to the vertical phase, with different sizes of the wing that contacts the plate;

FIGS. 26, 27 and 28 represent a top view of the reverse form plate to be employed in the truss according to the present invention, said plate being of three different sizes;

DETAILED DESCRIPTION OF THE PREFERRED EMBODIMENT

Figure 1:
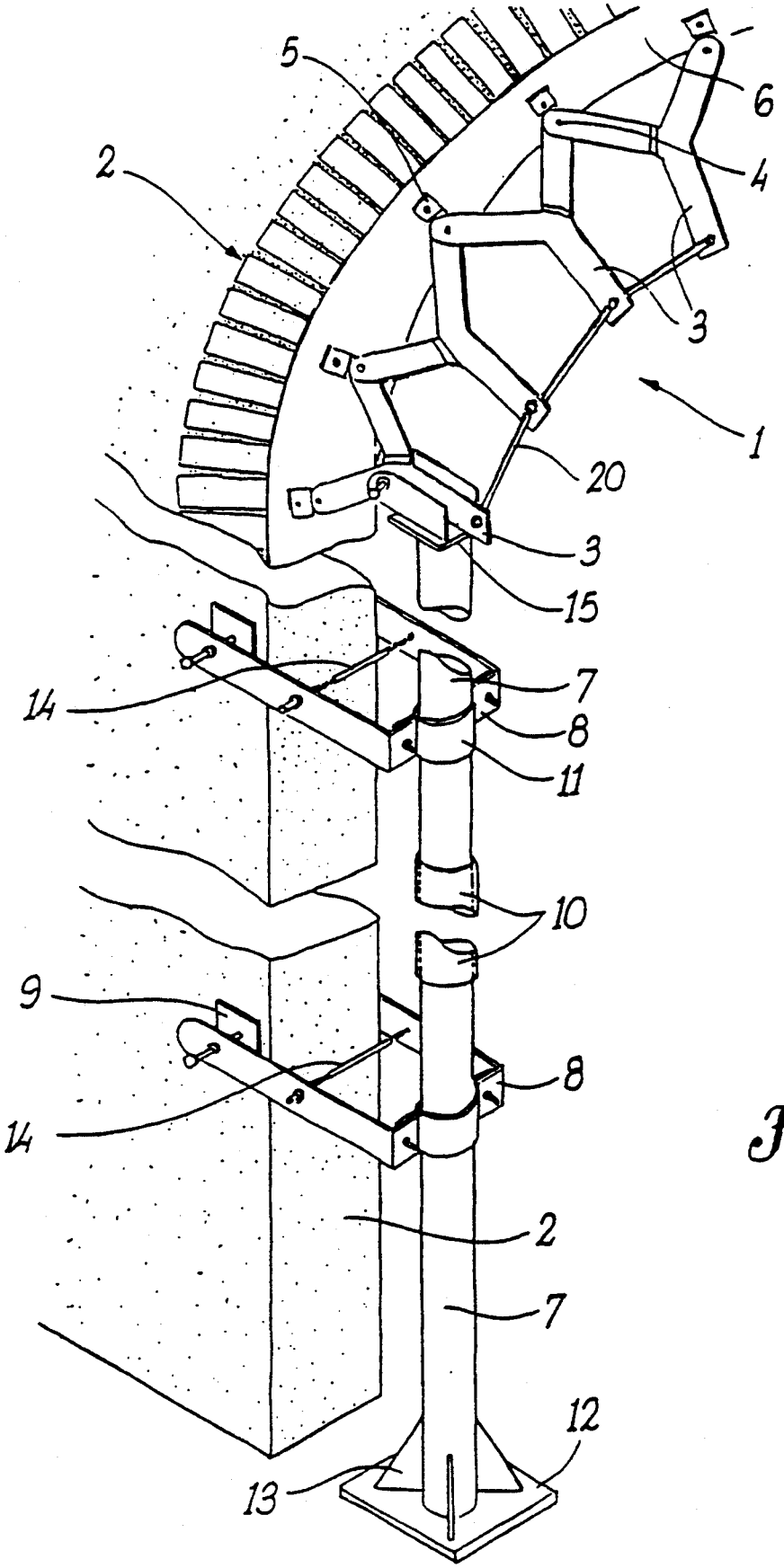
FIG. 1 shows a partial cross sectional view of the whole centering frame lattice structure according to the invention as fastened to a masonry work and provided with a propping means.

As can be observed in FIG. 1, the truss centering frame structure 1 is shown while it is performing its supporting action with respect to the arch-shaped masonry work 2.

The structure 1 is essentially composed of a series of Y-shaped rod modular members 3, which are joined to one another at the points corresponding to the upper knots or hinge joints 4 and then are connected through supporting saddles 5 to the forming member 6 which is made up of a flexible metal sheet.

Such member 6 is adapted to the profile of the masonry work 2 so that a constant load distribution is obtained along the metal sheet.

The centering frame structure 1 is supported at its ends by propping members 7 connected to the wall shoulder 2 through small anchoring square-shaped means 8 and through pressure platelets 9.

Additionally, the various lengths that make up the prop 7 are kept together by adjustment sleeves 10 and are fastened to the anchoring means 8 through members that are fastened to the prop 11.

Figure 2:
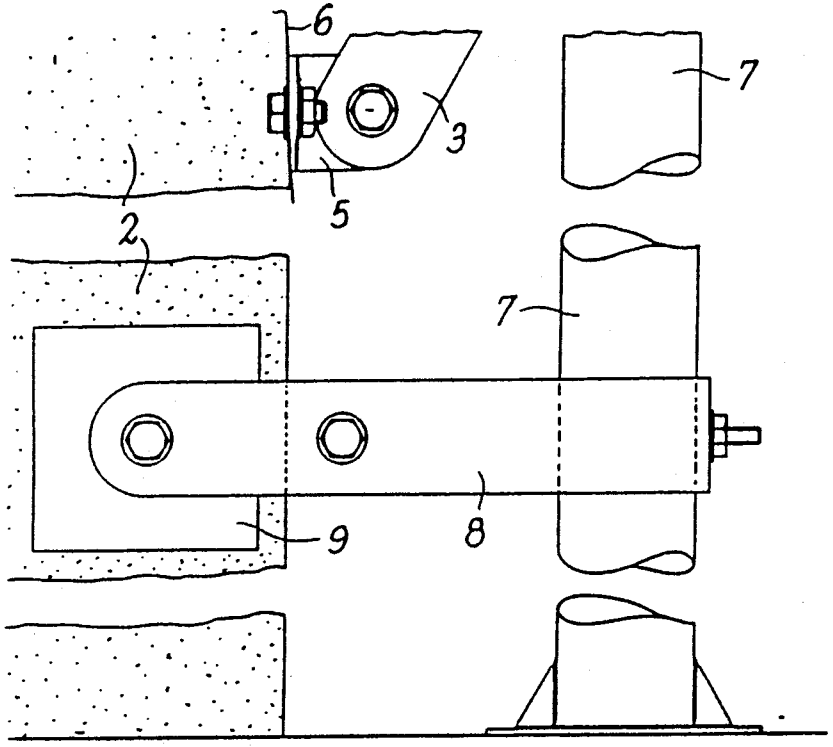
FIG. 2 shows a front view of a detail of the hooking system of the truss to the masonry work.
Figure 8:
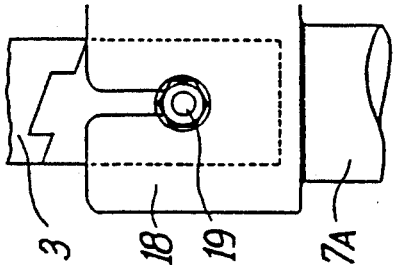
FIG. 8 shows a front view of the hooking system of FIG. 7.

Such details can be observed more clearly in FIG. 2, wherein the connection system between the upper end of the Y-shaped rod modular member 3 and the forming member 6 made of metal sheet is illustrated by means of a schematic cross-sectional view, said view also showing the connection between the pier of the prop 7 and the masonry work 2 by means of the small anchoring means 8 and of the platelets 9, and finally the plate 12 resting on the ground of the pier of the prop 7.

Moreover, such plate bears four small square-shaped strengthening members 13 for increasing the stability of the structure.

Figure 4:
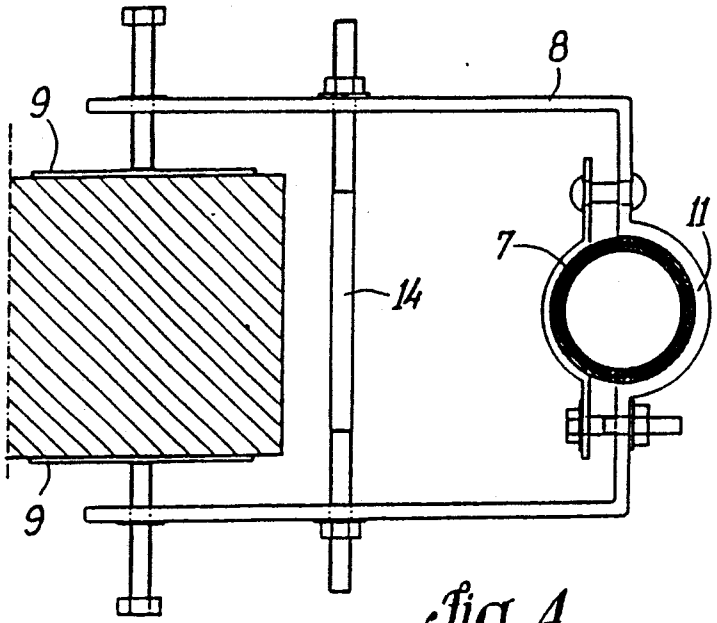
FIG. 4 shows a horizontal cross-sectional top view of the hooking system of the prop to the masonry work.
Figure 3:
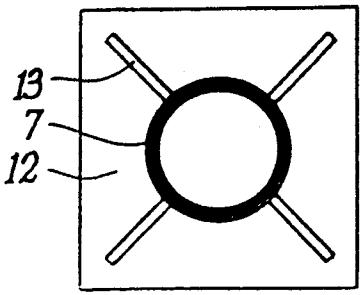
FIG. 3 shows a top view of the basis of the prop as horizontally cross sectioned.

FIG. 4 illustrates tensile member 14 of the anchoring square member 8 which is intended for the adjustment of stresses exerted on said square member.

Turning now again to FIG. 1, it can be observed that the fastening between the terminal Y-shaped rod modular member 3 and the supporting prop 7, occurs at the points corresponding to the middle portion of the same member by means of a saddle 15.

Figure 5:
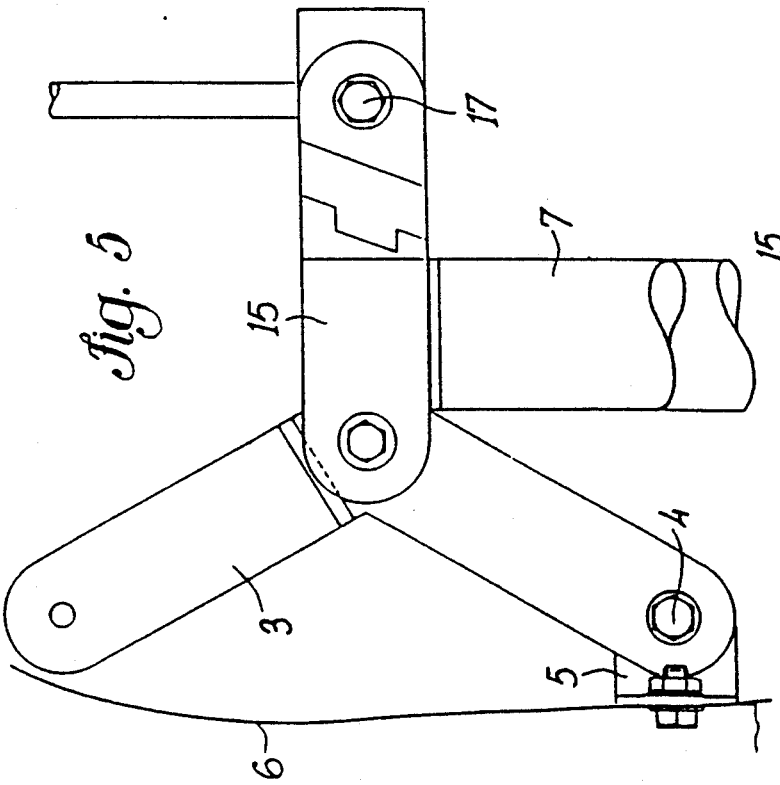
FIG. 5 shows a partial cross-sectional front view of one of said planar modular rod members which is connected to one of the two vertical supports.
Figure 6:
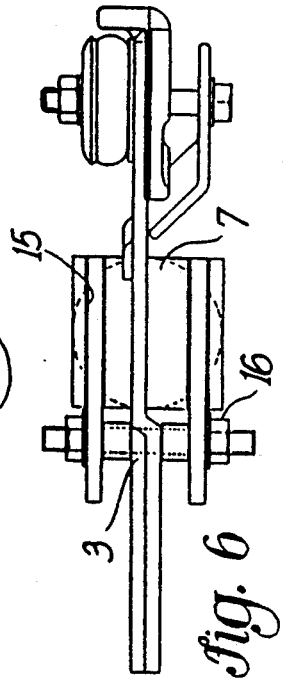
FIG. 6 shows a horizontal cross-sectional view of the member illustrated in FIG. 5.

Such arrangement is illustrated with more details in FIGS. 5 and 6.

Indeed, FIGS. 5 and 6 show that the upper portion of the prop 7 that bears the saddle 15 engages with the middle portion of the member 3 to which it is fastened by means of a through bolt 16, so that stability is assured.

Figure 7:
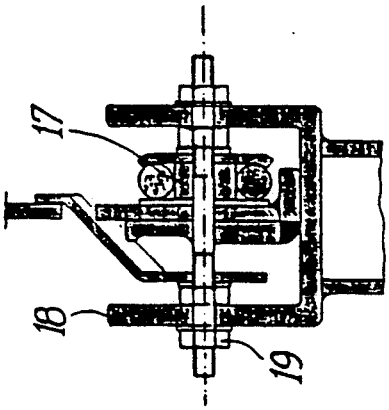
FIG. 7 shows a vertical cross-sectional view of the hooking system between the Y-shaped modular member at the crown of the arch and the supporting prop.
Figure 7:
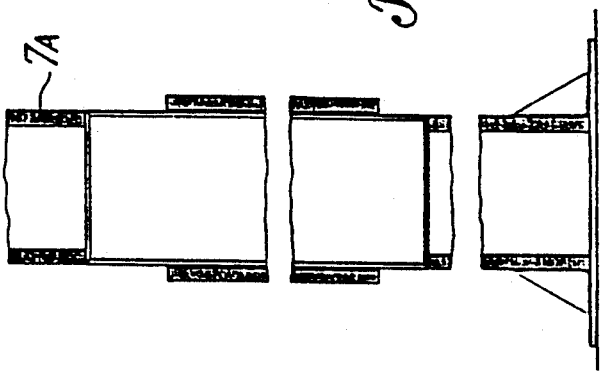

FIG. 7 shows on the contrary a vertical cross-sectional view of the connection between the three-branched Y-shaped rod modular member 3 at the arch crown (not observable in FIG. 1) and the supporting prop arranged at the central position of the structure 7A.

Such connection, as can be observed, occurs at the point corresponding to the lower hinge 17 of the rod modular member 3 which engages with a saddle 18 and is fastened to the same by means of the through bolt 19.

Figure 9:
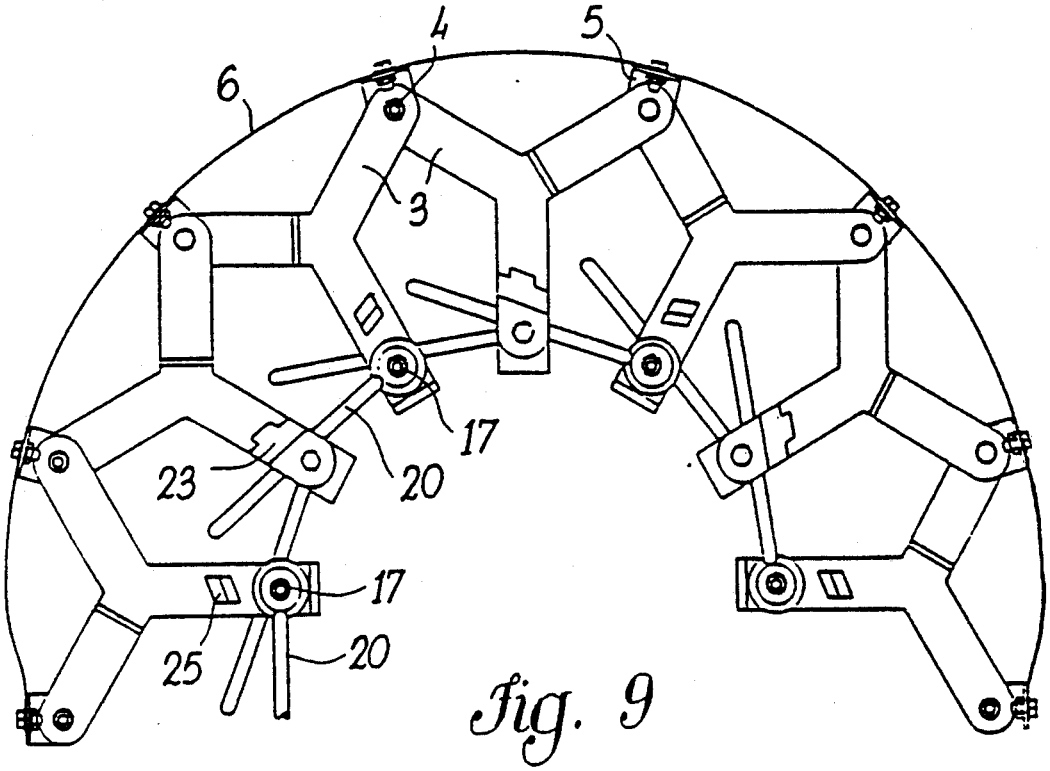
FIG. 9 shows a view of the whole centering frame lattice structure adapted along a bent profile.

As can be observed in FIG. 1 and much more clearly in FIG. 9 wherein a front view is shown of the truss 1 of FIG. 1 without the props 7A, each one of the Y-shaped members 3 is connected to the next member both at the points corresponding to the upper knots 4 which consist of a double-square shaped saddle 5 to which the two overlapped ends of each one of the adjacent rod modular members 3 are fastened by means of bolt and nut, and at the point corresponding to a lower joint. (A more detailed disclosure of the joint system will be given in the following).

Such joint substantially consists of a slide rod 20 endowed with a rounded end with eye loop which is rotatably engaged as a hinge with respect to the lower end of the Y-shaped rod modular member 3, and wherein its longitudinal portion is intended for engagement with a corresponding slide provided in the rear part of the lower hinge joint of each one of said Y-shaped members.

According to the different bending radii to which the truss 1 is to be adapted, the members 3 take on different mutual positions which are obtained through a mutual rotation with respect to the upper hinge to which different positions of the rods 20 correspond with respect to knots 17.

Fastening of each slide rod 20 at the lower knot 17 of the Y-shaped rod modular member 3 adjacent at the position corresponding to that given by the bending, is assured by the fastening action exerted on the nuts (which are not observable in FIGS. 1 and 9) and by friction arising on the surfaces of members in contact.

Figure 10:
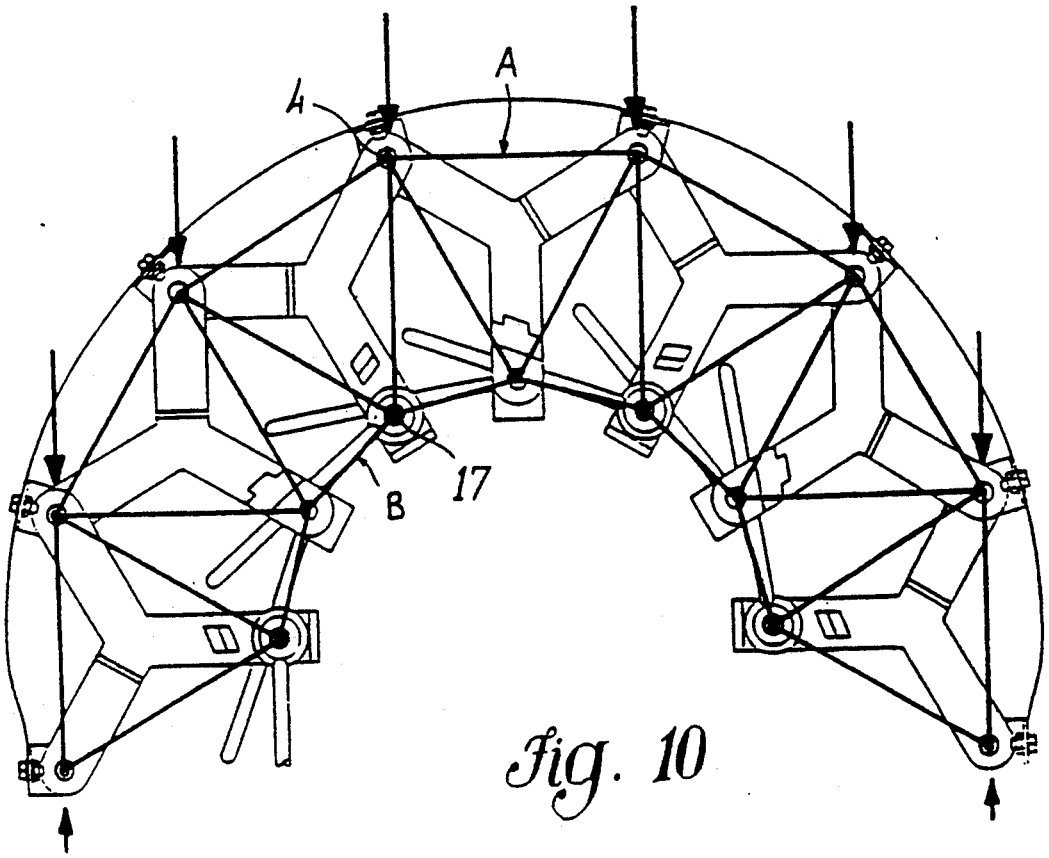
FIG. 10 shows a schematic view of the behavior and of the load distribution on the truss of FIG. 9.

FIG. 10 shows schematically the behavior of the load distribution in the truss 1 under the hypothesis that such structure be taken as associated to the arch masonry work 2 shown in FIG. 1.

As can be remarked, the concentrated load supported by the forming member 6 which is made up of metal sheet is transferred by said member to the upper knots 4 of members 3, substantially in the form of a normal stress.

Between said upper knots and the lower knots 17 a truss scheme can be hypothesized in the shape of a triangle, said truss consisting of a succession of triangles A and B whose bases are respectively made up of the virtual rod joining the upper knots 4 and of the virtual rod joining the lower knots 17.

As can be easily seen, the resultants of the upper loads concentrated at the knots give rise to normal tensile stresses along each one of the rods of the virtual truss.

Owing to such tensile stresses, bending moments are generated in the actual structure around the static and geometric center of gravity of each Y-shaped member, which moments add to the effects of the normal and of the shear stresses.

FIG. 11 shows a front view of one of the Y-shaped rod modular members 3, which is essentially made up of three arms which are at 120° to one another and are endowed with holes at their ends, one of the upper bent arms having a transverse relief so that it lies in a slightly projecting plane with respect to the other members.

Indeed, in FIGS. 12 and 13 the portion 3A can be observed which is slightly projecting so that it can engage with the corresponding portion 3A of the adjacent member, and so that the whole truss lies on one only plane.

The particular arrangement of the members 3 and the construction details which allow such coplanar arrangement of members to be obtained can be understood by observing FIG. 9.

The relief 3A of one of the upper arms of the member 3 indeed will be alternatively on the right or on the left arm.

Figure 14:
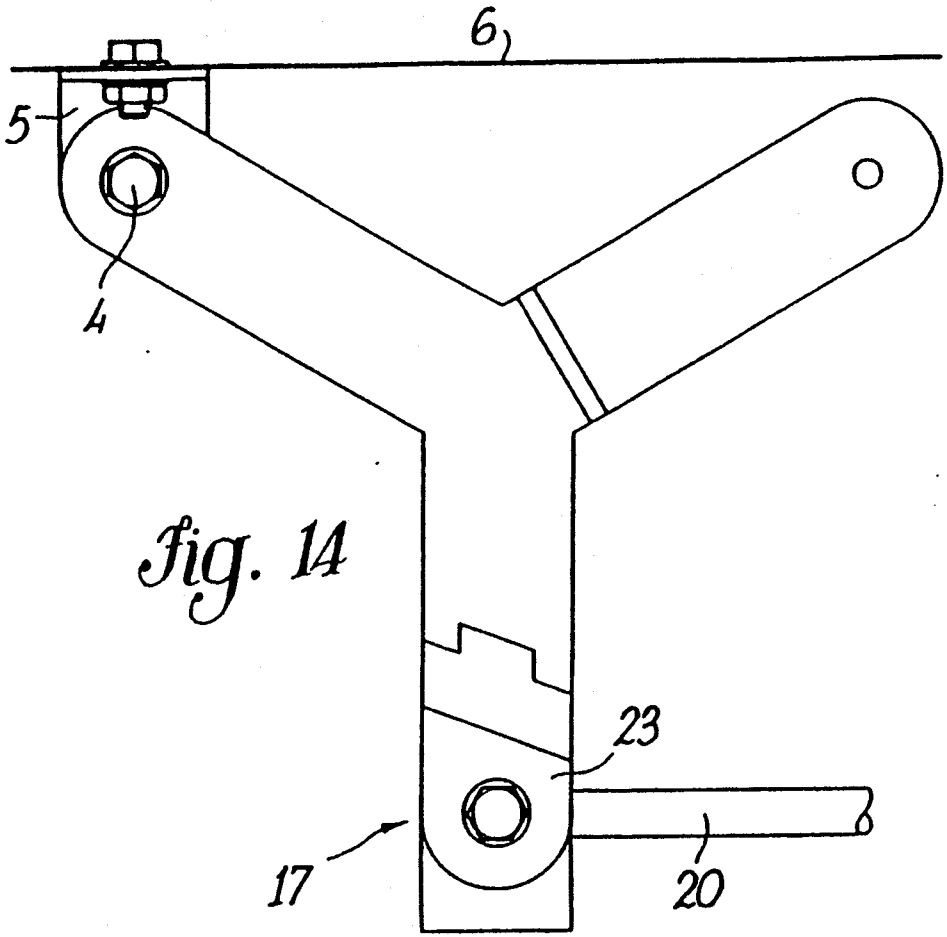
FIG. 14 shows a front view of the Y-shaped modular member connected to the plate and to the joint with the slide rod.

In FIG. 14, the Y-shaped rod modular member 3 is connected at the point corresponding to one of the upper ends to a square-shaped saddle 5 connected to the metal sheet 6. As can be better observed in FIG. 15, the saddle 5 consists of the mutual coupling 21 obtained through welding of two small symmetrical square-shaped members of the same sizes, which are provided in the upper part with a hole for engagement by means of bolt and nut 22 with eyelet holes (not shown) in the metal sheet 6 and in the lower part of a third bolt and nut member already pointed out schematically with the numeral 4, for engagement with the ends of two Y-shaped rod modular contiguous members 3.

In the lower joint 17 are provided, on the contrary, respectively in the fore part and in the rear part of the member 3, a bent plate member 23 intended for engagement, at the point corresponding to the end tooth 24, with the member 3 by passing through a hole 25 drilled in the same, as well as a square-shaped member 26 welded to the lower end of the rod modular member 3 and endowed with a sloping grooved profile 27 for engagement with the slide rod 20 of the joint of the adjacent member 3 and the closure split pin 28 that bears, at the point corresponding to the rear part of the member 3, the rounded end of the slide rod 20, the nut 29 and all other members intended for realizing the joint 17 being also provided.

Figure 15:
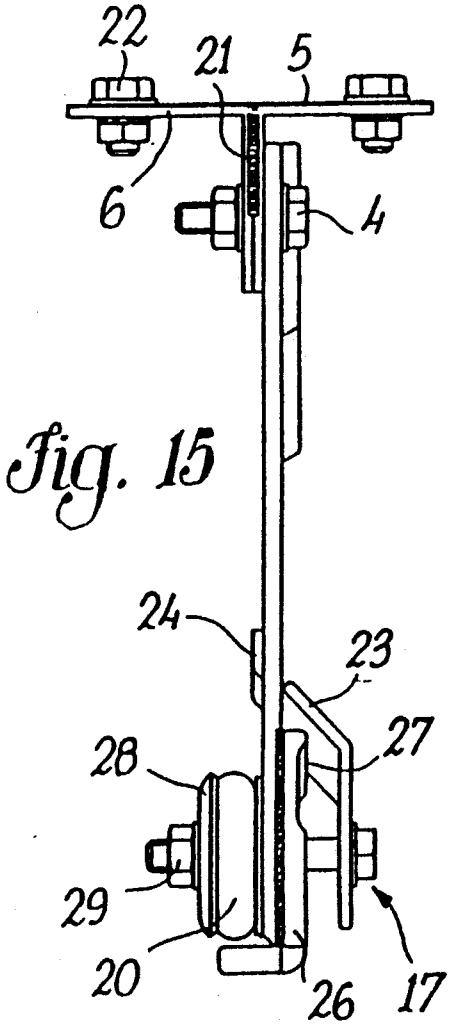
FIG. 15 shows a side view of the member of FIG. 14.
Figure 17:
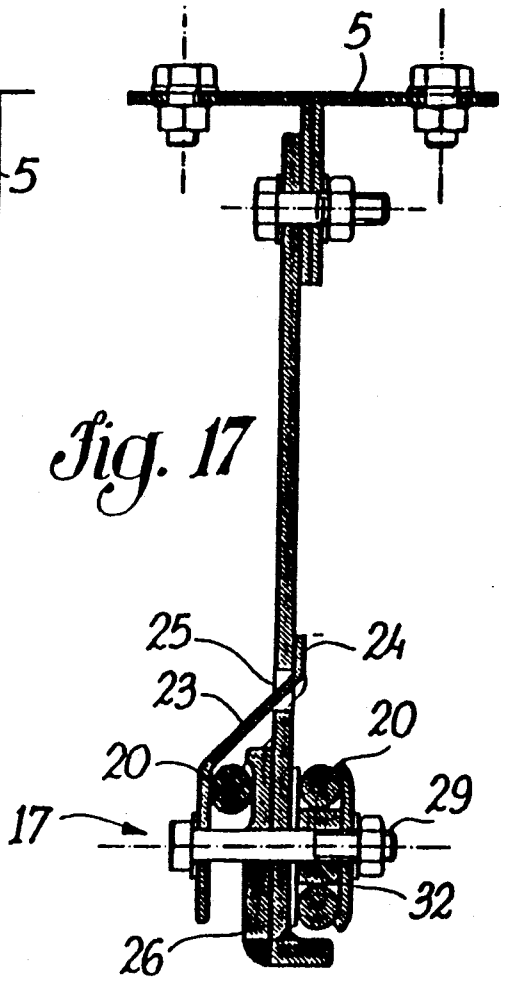
FIG. 17 shows a vertical cross-sectional side view along the line C—C of the member of FIG. 16.
Figure 16:
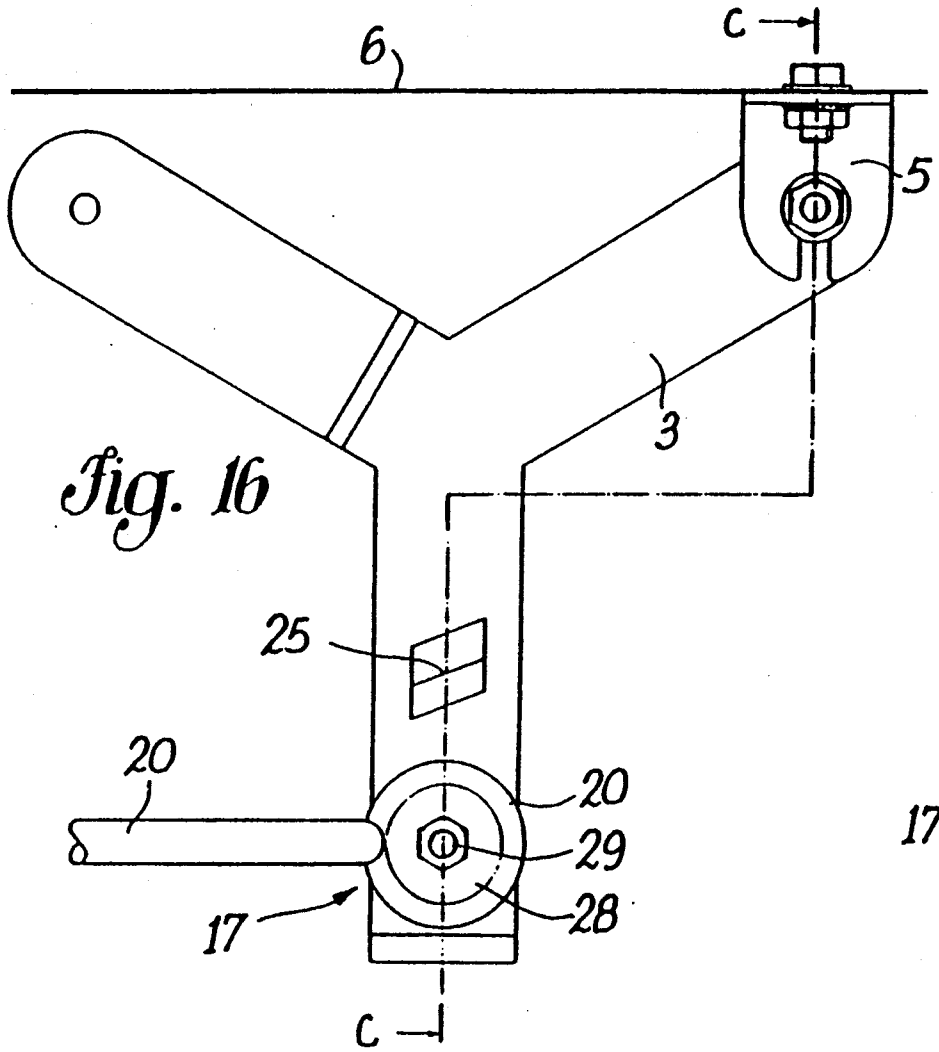
FIG. 16 shows a rear view of the member illustrated in FIG. 14.

Indeed, as can be observed both in FIG. 15 and in FIGS. 16 and 17, the connection between two successive members 3 is obtained in the lower part by fastening the slide rod 20 between the bent plate member 23 and the grooved portion of the square-shaped member 26.

Figure 18A:
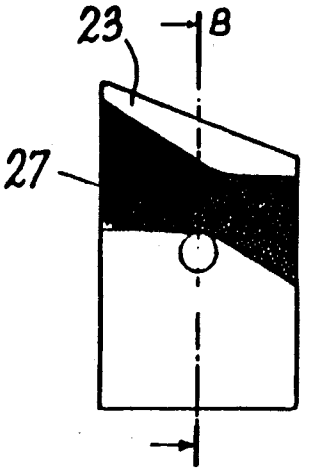
FIGS. 18A, 18B and 18C show respectively a front view, a side view and a vertical cross-sectional view along the line B—B of a member that forms the lower joint.
Figure 18B:
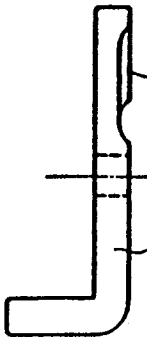
Figure 18C:
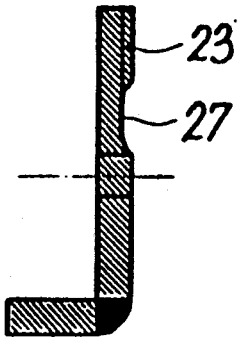
Figure 19:
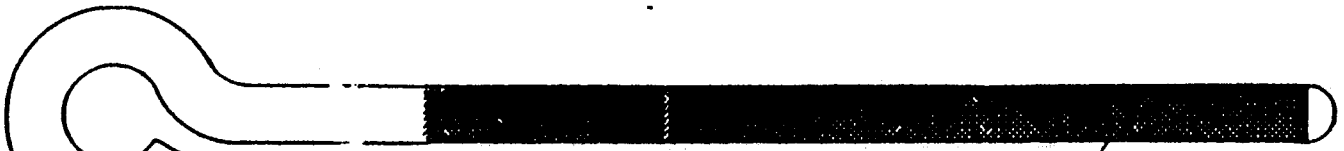
FIG. 19 shows a front view of the slide rod that is provided at the lower joint.

In the FIGS. 18, 19 and 22 the fact is put into evidence that a high friction force is created between such members also as a result of the rough surface of the groove 27 in the bent plate member 23, which groove also has a tendency to become narrower at the central part and then to become wider towards the edge of the member 23, always following the same slope (remark the different position of the groove 27 in the side views 18B and 18C).

In a similar way (FIG. 22A) a portion 29 substantially trapezoidal in shape of the plate member 23 has a rough surface for engagement with the corresponding surface 30 of the slide rod 20 (FIG. 19).

On the contrary, the bent portion of an additional rod 20 will be so arranged as to rotate pivotedly with respect to the sleeve 32 (FIGS. 20A and 20B) and it will be closed in its outer part by the split pin 28 (FIGS. 21A and 21B).

Thus, by fastening the bolt, the bent end and the longitudinal portion 30 of the two slide rods 20 converging to the lower knot 17 of each member 3, the slide rods 20 are locked respectively in the pre-selected position so that they can be adapted to the bent profile of the masonry to be supported.

FIGS. 23 and 24 show, as front and side views respectively, the square-shaped saddle 5 which has a rounded end provided with a groove 52 in its vertical portion for the passage of the fastening bolt.

The member 5 pointed out in FIG. 25 is a further embodiment of the invention, suitable for engagement with a metal-sheet forming member 6 of larger sizes (like that pointed out in FIG. 28) wherein the eyelet holes 33 are in a more advanced position towards the outside edges of the member 6.

The shape of the holes 33 allows tolerances and clearances arising from the particular arrangements along a bent perimeter of the Y-shaped members 3 to be absorbed.

The distance between successive pairs of holes, and hence the distance between the ends of the bent arms of each Y-shaped member is a function of the dimensional series of the Y-shaped members adopted, which is in turn determined by the particular arrangement of loads.

Figure 29:
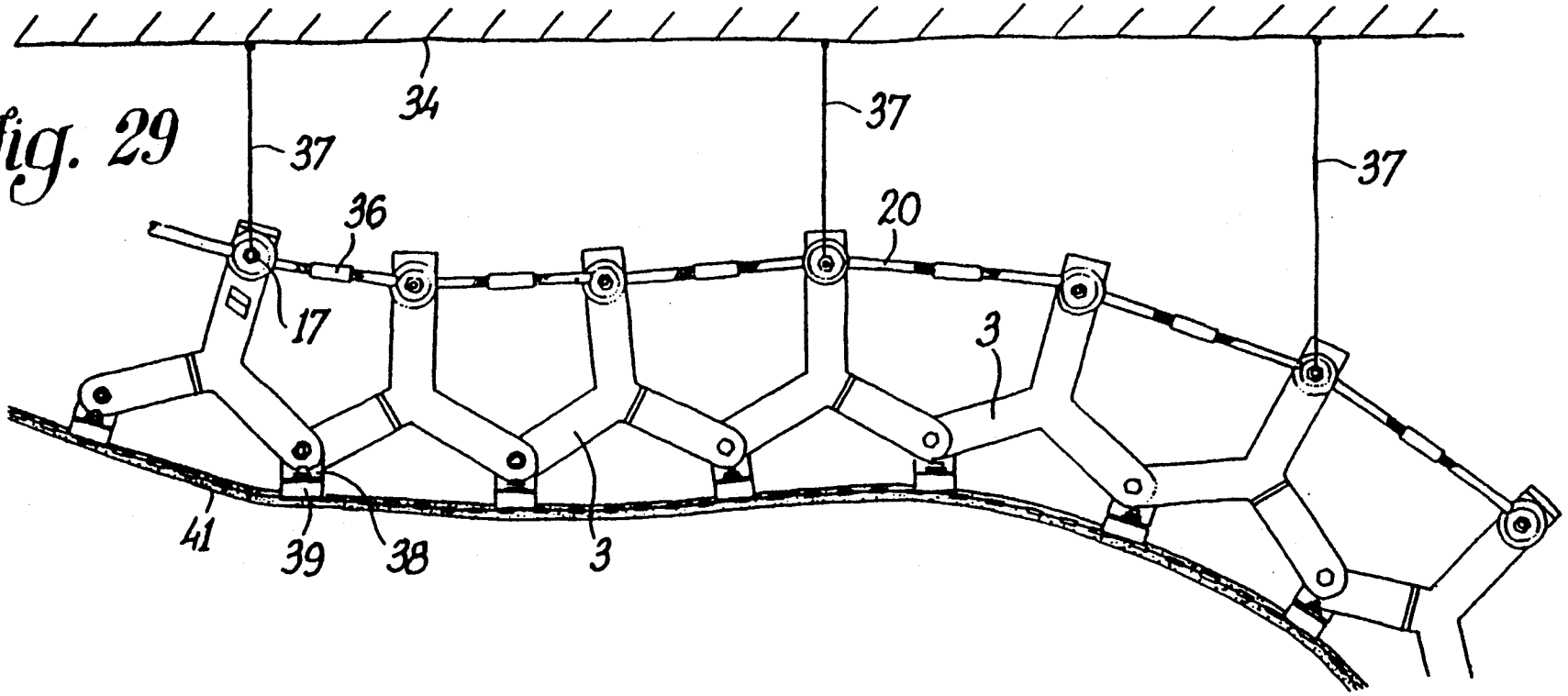
FIGS. 29 and 30 represent a front view of the centering frame lattice structure according to the present invention employed as a supporting structure for false ceilings, respectively of the continuous and of the plate type.
Figure 30:
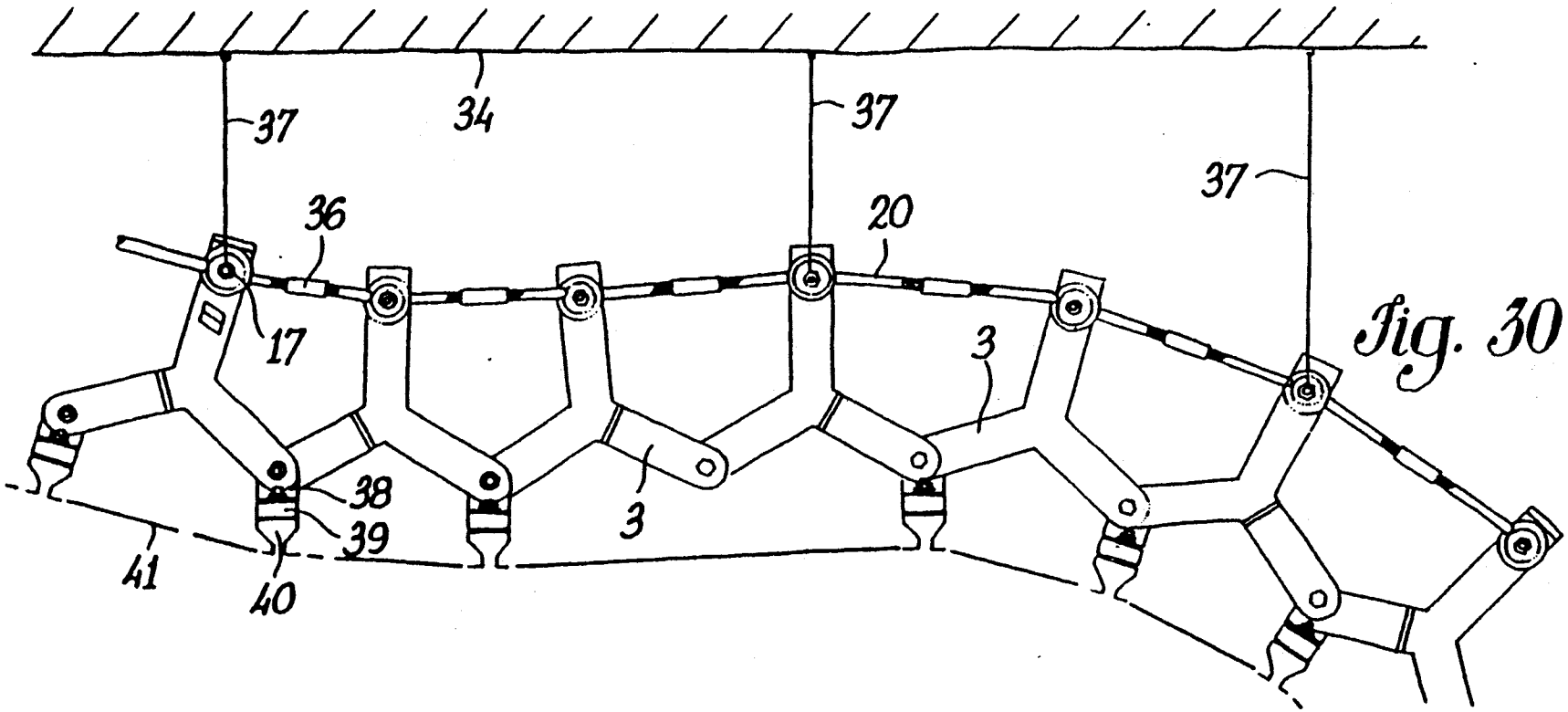
Figure 32:
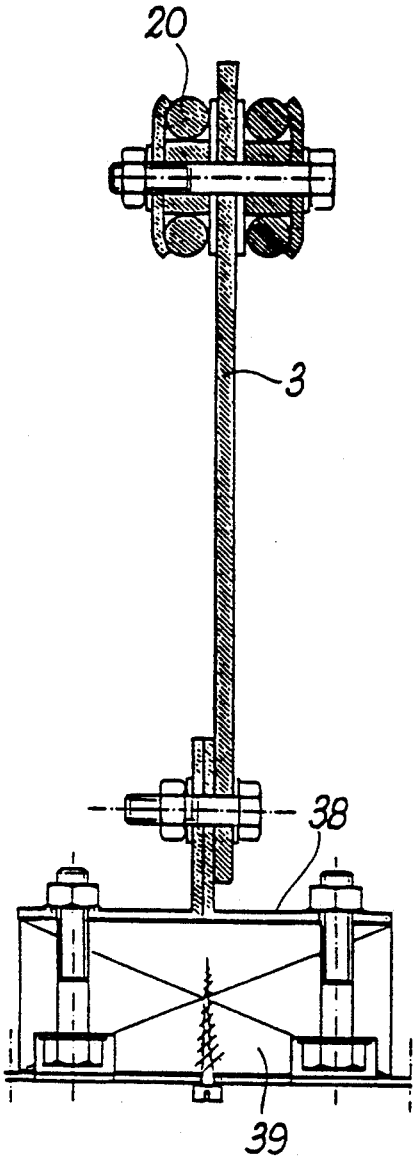
FIG. 32 shows a side view of the hooking system of an Y-shaped modular member employed as a support for a continuous structure false ceiling.

Finally, FIGS. 29 and 32 represent a particular arrangement of the truss 1 for building continuous finishing (FIG. 29) or plate (FIG. 30) bent profile false ceilings.

As can be observed, members appear overturned so as to support the false ceiling structure 35 to be connected to the intrados of the floor 34 arranged at the points corresponding to the lines joining the bent ends of the oblique sides of each member 3.

The end of each longitudinal portion of the member 3 is joined to the next one by means of the slide rods 20 which are endowed with the connection and adjustment sleeve 36.

Thus, a continuous lattice structure or truss is formed, which is connected to the intrados of the floor 34 by means of steel strands 37 connected to the joint 17.

The connection with the continuous false ceiling structure occurs through an anchoring saddle 38 and a small fastening block 39.

Such configurations is illustrated in a more detailed way in FIG. 32, wherein the anchoring saddle 38 can be seen as connected to the small block 39, which is in turn fastened to the member to be supported.

According to a preferred embodiment of the invention, both bent portions of two different slide rods 20 converge to the upper joint.

Figure 31:
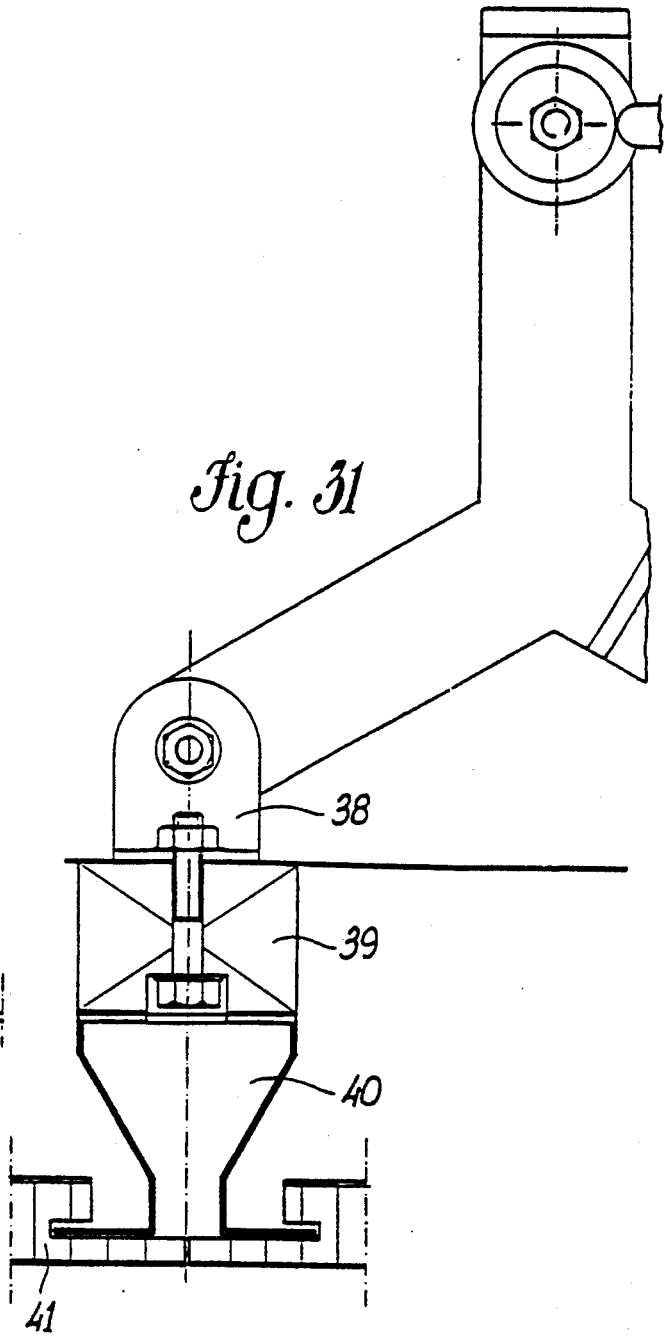
FIG. 31 shows a front view of the hooking system of an Y-shaped modular member which is employed as a support for a plate type false ceiling, and the underlying bearing structure.

FIG. 31 shows on the contrary the system connecting a modular rod member to a plate-type false ceiling, wherein the anchoring saddle 38, the small block 39 fastened by means of a bolt, and an Ω-shaped member 40 for anchoring the plates 41 are shown.

The present invention has been disclosed just for illustrative and not for limitative purposes, according to some preferred embodiments of the same, but it is to be understood that modifications and/or changes can be introduced by those who are skilled in the art without departing from the spirit and scope of the invention.

I claim:

1. A variable set-up, reusable centering frame for employment as a movable and a stationary structure, comprising:

a succession of modular rod members each having a first upper branch, a second upper branch and a lower branch;

a continuous forming member;

connection means for pivotably connecting said first and second upper branches to said continuous forming member;

slide rods, said slide rods extending between adjacent lower branches of said modular rod members, and said slide rods having a first end pivotably secured to a respective lower branch at a first securement location and a second end, said second end being adjustably secured with fastening means to an adjacent lower branch at a second securement location such that spacing between said first and second securement locations is variable to provide for adaption of said continuous forming member to a desired shape.

2. A variable set-up, reusable centering frame according to claim 1, characterized in that said modular rod members are Y-shaped.

3. A variable set-up, reusable centering frame according to claim 1, characterized in that said modular rod members are planar.

4. A variable set-up, reusable centering frame according to claim 1, characterized in that said fastening means are made up of movable, bent-plate means which are provided with tooth means for engagement with the modular rod members and for fastening said slide rods between said bent-plate means and said modular rod members.

5. A variable set-up, reusable centering frame according to claim 1 wherein each of said lower branches includes a first side and a second side, and said fastening means includes a bent plate and a bolt fastening member, said second end of said sliding rod extending between said first side of said lower branch and said plate and is releasably clamped between said plate and said first side by said bolt fastening member.

6. A variable set-up, reusable centering frame according to claim 5 wherein the first end of said slide rods is pivotably secured to the second side of said lower branch.

7. A variable set-up, reusable centering frame according to claim 6 wherein the first side of each of said lower branches includes a groove through which extends the second end of said slide rods.

8. A variable set-up, reusable centering frame according to claim 7 wherein said groove is defined by a roughened, friction enhancing surface.

9. A variable set-up, reusable centering frame according to claim 8 wherein the second end of said slide rod includes a roughened friction enhancing surface.

10. A variable set-up, reusable centering frame according to claim 6 wherein the first end of said slide rod includes a rounded end with an eye loop and is pivotably secured to said lower branch by said bolt fastening member which extends through the eye loop.

11. A variable set-up, reusable centering frame according to claim 1 wherein said fastening means includes adjustment sleeves which adjustably interconnect the second ends of adjacent slide rods.

12. A variable set-up, reusable centering frame according to claim 11 wherein said modular rod members are Y-shaped shaped and positioned in an overturned manner wherein the aforementioned lower branch is secured to an upper supporting structure and the aforementioned upper branches extend off from a lower end of said lower branch so as to position said continuous forming member at a position below the upper supporting surface.

13. A variable set-up, reusable centering frame according to claim 11 wherein said slide rods each include an eye loop at the first end and said first and second upper branches each include a first side surface and a second side surface which each pivotably support an eye loop end of a pair of oppositely extending slide rods.

14. A variable set-up, reusable centering frame according to claim 1 further comprising a prop-like supporting member which includes a prop saddle at an upper end, said prop saddle being secured to one of said modular rod members.

15. A variable set-up, reusable centering frame according to claim 14 wherein said prop-like supporting member includes means for height adjustment.

16. A variable set-up, reusable centering frame according to claim 14 further comprising anchoring means for anchoring said prop-like support member to an adjacent structure and a support plate which is positioned at a lower end of said prop-like support member, and said anchoring means being positioned between said support plate and said prop saddle.

17. A variable set-up, reusable centering frame according to claim 1 wherein said continuous forming member includes a flexible sheet of material extending over a plurality of first and second upper branches and said connection means includes supporting saddles spaced along said forming member and, at an upper end thereof, secured to said forming member and, at a lower end thereof, are secured to a first upper branch of a first of said modular rod members and to a second upper branch of a second of said modular rod members positioned adjacent said first of said modular rod members.

18. A variable set-up, reusable centering frame according to claim 1 wherein said first upper branches are planar and include a planar base portion, an intermediate bend and an external planar offset portion which lies on a plane parallel and offset to a plane lying flush on said base portion.

19. A variable set-up, reusable centering frame according to claim 17 wherein said supporting saddles include a coupling which extends away from said continuous forming member and includes a first surface and a second surface, the external offset portion of the first upper branch of said first of said modular rod members being pivotably secured and juxtaposed to the first surface of said coupling member and the second upper branch of said modular rod members being pivotably secured and juxtaposed to the second side of said coupling members.

20. A variable set-up, reusable centering frame for employment as a movable and stationary structure, comprising:

a plurality of modular rod members each having a pair of upper branches and a lower branch, and the upper branches of said modular rod members being hingedly connected to upper branches of adjacent modular rod members;

supporting saddles hingedly connected to the upper branches of said modular rod members;

a forming member adapted to assume a curved configuration, said forming member extending across a plurality of upper branches of said modular rod members, and said forming member being connected to said supporting saddles;

slide rod members extending between adjacent pairs of the lower branches of said modular rod members, said lower branches having a first side and a second side with said first side having a groove formed therein with the surface of said lower branch defining said groove being roughened for enhanced friction, and said slide rod having a first end and an elongated second end;

fastening means for fastening said elongated second end within said groove, said fastening means further fixing in place the first end of said slide rod to the second side of said lower branch, and said fastening means being such that said slide rods can be adjusted in position within said groove and said first end of each of said slide rods can be rotated with respect to the lower branch which supports the slide rod.

21. A variable set-up, reusable centering frame for employment as a movable and a stationary structure, comprising:

a succession of modular rod members having a first upper branch, a second upper branch and a lower branch;

a continuous forming member;

connection means for pivotably connecting said first and second upper branches to said continuous forming member;

slide rods, said slide rods extending between adjacent lower branches, and said slide rods having a first end pivotably secured to a respective lower branch and a second end, said second end being adjustably secured with fastening means to an adjacent lower branch such that spacing between said adjacent lower branches is variable to provide for adaption of said continuous forming member to a desired shape, and wherein each of said lower branches includes a first side and a second side, and said fastening means includes a bent plate and a bolt fastening member, said second end of said sliding rod extending between said first side of said lower branch and said plate and is releasably clamped between said plate and said first side by said bolt fastening member.

22. A variable set-up, reusable centering frame for employment as a movable and a stationary structure, comprising:

a succession of modular rod members having a first upper branch, a second upper branch and a lower branch;

a continuous forming member;

connection means for pivotably connecting said first and second upper branches to said continuous forming member;

slide rods, said slide rods extending between adjacent lower branches, and said slide rods having a first end pivotably secured to a respective lower branch and a second end, said second end being adjustably secured with fastening means to an adjacent lower branch such that spacing between said adjacent lower branches is variable to provide for adaption of said continuous forming member to a desired shape, and wherein said continuous forming member includes a flexible sheet of material extending over a plurality of first and second upper branches and said connection means includes supporting saddles spaced along said forming member and, at an upper end thereof, secured to said forming member and, at a lower end thereof, are secured to a first upper branch of a first of said modular rod members and to a second upper branch of a second of said modular rod members positioned adjacent said first of said modular rod members.

23. A variable set-up, reusable centering frame for employment as a movable and a stationary structure, comprising:

a succession of modular rod members having a first upper branch, a second upper branch and a lower branch;

a continuous forming member;

connection means for pivotably connecting said first and second upper branches to said continuous forming member;

slide rods, said slide rods extending between adjacent lower branches, and said slide rods having a first end pivotably secured to a respective lower branch and a second end, said second end being adjustably secured with fastening means to an adjacent lower branch such that spacing between said adjacent lower branches is variable to provide for adaption of said continuous forming member to a desired shape, and wherein said first upper branches are planar and include a planar base portion, an intermediate bend and an external planar offset portion which lies on a plane parallel and offset to a plane lying flush on said base portion.

* * * * *